United States Patent [19]

Hanff

[11] 4,015,574

[45] Apr. 5, 1977

[54] APPARATUS FOR IMPROVING FUEL-AIR MIXTURE

[76] Inventor: Roy A. Hanff, 569 Lawrence Drive, San Luis Obispo, Calif. 93401

[22] Filed: Nov. 18, 1974

[21] Appl. No.: 524,885

[52] U.S. Cl. ..... 123/141; 48/180 R; 261/79 R

[51] Int. Cl.[2] ..... F02M 29/00

[58] Field of Search ..... 123/141; 48/180 R, 180 M, 48/180 S; 261/79 R

[56] References Cited

UNITED STATES PATENTS

| | | | |
|---|---|---|---|
| 1,113,041 | 10/1914 | Murphy | 48/180 R |
| 1,305,064 | 5/1919 | Cochran | 48/180 R |
| 1,327,699 | 1/1920 | Camp | 48/180 R |
| 1,485,927 | 3/1924 | Holland | 48/180 R |
| 1,490,233 | 4/1924 | Ruther | 48/180 R |
| 1,607,183 | 11/1926 | Bundy | 48/180 R |
| 1,710,601 | 4/1929 | Bailey | 48/180 R |
| 1,761,473 | 6/1930 | Gockel | 48/180 R |
| 1,857,070 | 5/1932 | Thomas | 48/180 M |
| 1,937,875 | 12/1933 | Denman et al. | 123/141 |
| 2,701,557 | 2/1955 | Ramey | 48/180 R X |

*Primary Examiner*—C. J. Husar
*Assistant Examiner*—Ira S. Lazarus
*Attorney, Agent, or Firm*—J. B. McGuire

[57] ABSTRACT

A reactor plate having a plurality of openings equal to the number of bores of a carburetor and positioned between the carburetor outlet and the engine intake manifold. A plurality of ribs or spokes radiate outwardly from, and are fixed between, a central hub in each opening and the plate at the periphery of the opening. Each spoke has a plurality of machined surfaces thereon so located as to stimulate turbulence in the fuel-air mixture flow and increase the percentage of fuel completely mixed with air. The total remaining area of each opening, between the spokes and the hub, is equal to the area of the carburetor bore outlet.

25 Claims, 4 Drawing Figures

19
17
41
19
11
21
25a
27
45
13
23
25a
25
IV
IV
13
21
25
25
27
II
II
45
13
43
15

42
37
35
31
33
25

27
45

17
41
21
II
11
II
43
15

APPARATUS FOR IMPROVING FUEL-AIR MIXTURE

BACKGROUND OF THE INVENTION

In the internal combustion engines found on most automobiles today, the engine takes in large volumes of air at a relatively rapid rate through venturis in a carburetor. A reduction of pressure generated in the venturis causes gasoline to be entrained in the air stream for combustion within the cylinders of the engines. The presently available carburetors accomplish approximately 37 to 43% vaporization of the gasoline in the air. This low vaporization rate results in incomplete and inefficient combustion of the gasoline in the engine cylinders, resulting in relatively poor gasoline mileage for the vehicle being driven and a high output of those products of combustion generally referred to as pollutants.

Today, massive efforts are being undertaken by the government and the public to accomplish fuel savings as well as to reduce pollution in the air. However, when a conflict arises between these two goals, in many instances the reduction of pollutants is given the greater priority. Obviously, it would be desirable to have an internal combustion engine with both fuel economy and low pollution output. Unfortunately, in reducing pollution output, many devices now required on automobiles actually end up reducing fuel economy. For example, those devices presently being required on many automobiles in the State of California to reduce the oxides of nitrogen emitted reduce the engine efficiency by as much as 8–15% thereby increasing the amount of fuel required.

In the past, many designers have undertaken development of devices which can be used on an automobile to improve the vaporization of fuel in the air flow traveling to the combustion chambers. Some of these devices have comprised fans or turbines mounted on the downstream side of the carburetor, the blades of which are tilted at angles to the axes thereof to cause rotation of the turbine by air flow. In certain devices, some of the blades in these turbines were so configured as to resist rotation of the turbine. In either of these systems, however, severe engine damage could occur if a blade broke, a bearing wore out, etc.

In other cases, flow impeding devices have been fixed between the carburetor and the intake manifold and have been provided with various blade-like configurations which served to control the direction of flow of the fuel-air mixture and provide vaporization surfaces for additional breaking up the fuel droplets.

Unfortunately, all of these prior art devices have been unsuccessful and/or undesirable in one manner or another. For example, some of them diminished the performance of the automobile significantly by increasing centrifugal turbulence to such an extent that the fuel could re-liquify on the wall of the intake manifold. In other cases, the devices presented such a large obstruction to the flow of the fuel-air mixture as to effectively "starve" the engine and prevent sufficient combustible mixture from reaching the combustion chambers. In all cases, however, even when the degree of vaporization was improved, it was only to such a minor extent that use of the device was still economically unfeasible.

As a result, a need still exists to provide a device, either in the form of a carburetor or apparatus to work together with a carburetor, which will significantly improve the percentage of fuel which will be totally vaporized in air, thereby improving engine efficiency and reducing the undesirable products of combustion.

SUMMARY OF THE INVENTION

The present invention relates to apparatus which radically improves engine efficiency and, which logic dictates, reduces pollutant output since less fuel is burned and the percentage of fuel in a combustion chamber which is efficiently burned during engine operation is significantly increased for each combustion cycle. Basically, the present invention relates to what shall be hereinafter called a reactor plate which may be installed between the downstream side of a standard internal combustion engine carburetor and the upstream side of the engine intake manifold.

In a preferred form, the device may comprise a plate having a number of generally circular openings, corresponding to the number of bores in the carburetor. Extending from approximately the center of each opening are a plurality of equi-spaced ribs or spoke-like structures which are precisely located and so configured as to move the mixture in different, intersecting turbulent flows as it passes through the opening.

When such a reactor plate is used, it is preferred that the remainder of each circular opening, i.e., the space between the ribs or spokes, be equal in area to the cross sectional area of the carburetor bore and the intake manifold bore, which are normally identical in diameter. In order to accomplish this and still provide for the ribs or spokes to be positioned in the openings, the nominal diameter of the openings must be larger than that of the adjacent bores. In order to make full use of the diametrically increased opening areas, it is preferred that the ends of the bores adjacent the plate be machined or otherwise formed so as to be chamfered or counterbored to provide a reasonably smooth transition to and from the standard bore diameters to the nominal opening diameter in the reactor plate.

Further, it is also desired that one of the ribs or spokes in each opening of the reactor plate be positioned immediately below the intake fuel jet in the adjacent bore of the carburetor so as to ensure increased fuel turbulence in the air flow by causing a large part of the fuel to impinge upon it.

In the preferred embodiment of the invention, each spoke or rib may be precisely formed, in a manner to be described later, in such a way as to create a plurality of turbulent flows which must intermix just prior to the time that the mixture enters the intake manifold bore. Similarly, at the center of each opening, the ribs or spokes may join at a hub which has a central opening therein, enlarged in the direction of mixture flow. This and similar features of the structure will serve to provide "flats" in the vacuum drawn through the reactor plate, thereby stimulating turbulence.

In 1974, a test was made using a device embodying the present invention on a 1967 Ford having an engine with 390 cubic inches displacement and a two barrel carburetor. The automobile was driven over a prescribed course at a constant 55 miles per hour and the fuel usage was calculated to be 13.3 miles per gallon. For the same course at a constant 65 miles an hour, the fuel usage was calculated to be 12.8 miles per gallon.

When the same car was provided with a device embodying the present invention, at a constant 55 miles an hour over the same course, fuel usage was determined to be 29.23 miles per gallon. At a constant 65miles an hour, the fuel usage was found to be 26.98 miles per gallon.

Therefore, it is believed that the present invention conclusively produces results unavailable with any known prior art structure, derived from an increase in mixture efficiency from approximately 43% to approximately 93–98%.

Interestingly enough, it was found that use of the reactor plate embodying the present invention required the use of a low temperature coolant thermostat in the test automobile in order to prevent overheating in the engine to such an extent as would have caused severe damage.

It is believed that other objects and advantages of this invention will become apparent to those skilled in the art upon review of the following detailed description, taken together with the drawing. The detailed description and drawing show what is believed to be only the best embodiment of the invention, whereas the invention itself is clearly defined by the claims.

DETAILED DESCRIPTION

Figures 1, 2, 3, 4:
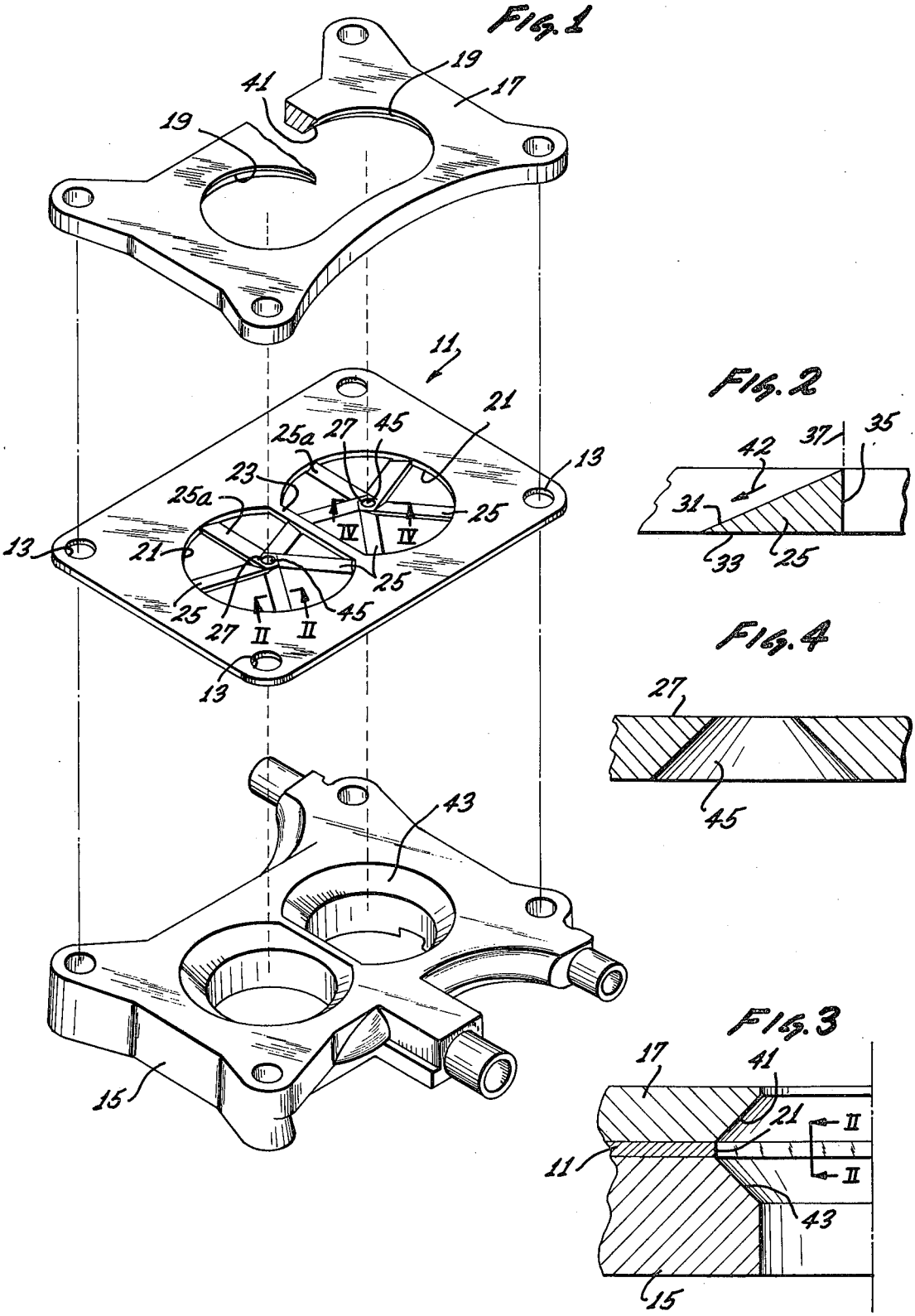
FIG. 1 comprises an exploded isometric view of the preferred embodiment of the present invention, together with engine structure illustrating its preferred position on the engine.
FIG. 2 comprises a cross-sectional illustration of one of the spokes in an opening in the reactor plate, as seen along the line II — II of either FIG. 1 or FIG. 3.
FIG. 3 comprises a partial sectional view of the assembled engine structure employing the present invention.
FIG. 4 comprises a sectional view of the hub, to which the spokes are connected at the center of an opening of the reactor plate, as seen along the line IV — IV of FIG. 1.

As shown on FIG. 1, there is illustrated what will herein be referred to as a reactor plate 11 having suitable bores 13 therein so that it may be fastened to the upper surface of a spacer plate 15. Plate 15 may, if desired, be a carburetor heat spacer plate which, in turn, is positioned on the intake manifold (not shown). An upper spacer 17 may be located immediately above the reactor plate so as to be positioned thereagainst. The assembled structure is partially illustrated in FIG. 3 and it will be understood by those skilled in the art that suitable gaskets (not shown) may be located between the spacers and the reactor plate.

In many cases, it will be desirable that the lower spacer be a carburetor heat spacer plate since its heating effect will increase the vaporization of fuel in the air.

With respect to the present illustration, it is presumed that the carburetor with which the preferred embodiment of the invention would be used is a two barrel carburetor. A pair of bores, through which the fuel and air mixed in the carburetor passes, extend toward the intake manifold of the engine. It should be born in mind throughout this description that the number of openings in the reactor plate and spacer plates should equal the number of bores through which mixture passes from the carburetor and that no other limitation is believed to be necessary. In other words, this invention may be applied to any carburetor, whether single or multiple bore.

As the mixture leaves the carburetor, it will pass through a pair of openings 19 in the upper spacer 17. In many cases, it may be necessary to use the upper spacer 17 to provide for sufficient space for operation of the carburetor butterly valve. Without the spacer, in other words, the butterfly valve might contact the reactor plate and operate improperly, if at all. Of course, in some cases the upper spacer may not be necessary at all.

In the reactor plate 11, there may be provided openings 21 which may be substantially circular in periphery. Between the two openings 21, a brace element 23 may extend between the edges of the plate both to provide sufficient strength as well as to separate the openings and segregate the mixtures passing therethrough.

Within each of the openings 21, there may be provided a plurality of rib or spoke-like members 25, which may be equi-spaced extending from the periphery toward the center of each opening and meeting at what shall hereinafter be referred to as a hub 27. The spokes may be rigidly fixed in place and any desired number may be utilized although five in each opening have been illustrated; this number has been found to be a reasonable compromise between size and efficiency.

Each of the ribs or reactor spokes 25 may compromise an upstream surface 31, a downstream surface 33, and a flow surface 35. As illustrated in FIG. 2, the upstream and downstream surfaces intersect at a straight line edge. As seen, the flow surface 35 is formed so as to be substantially perpendicular to that direction of flow. On the other hand, the upstream surface 31 is formed at an obtuse angle, relative to the direction of flow 37, which is downward as viewed in FIG. 2. It has been found desirable to form the upstream surface at an angle at least as great as 95° from the direction of flow line 37, but not more than 135° relative thereto. In practice, it has been found that excellent results are produced with this device if the upstream surface is formed at an angle approximately 113° relative to the flow direction as illustrated by line 37.

As illustrated in FIG. 1, it is also preferred that the spokes 25 in each opening 21 be oriented in the same direction, i.e., the upstream surfaces 31 are each on the same side of their respective flow surfaces 35, as seen from above. Thus, the direction of turbulence generation will be consistent throughout each opening. Similarly, it is preferred that the reactor spokes in each adjacent opening, if any, be oriented in the opposite direction, as illustrated. Such orientation will increase overall turbulence and fuel-air mixture, if the separate flows are later joined in their travel to a combustion chamber or chambers.

As the mixture passes through the reactor plate, it is preferred that a large percentage of it in each opening will hit a spoke 25*a* which may be located in each of the openings such that it is positioned directly below the metering jet in the carburetor. Consequently, a large portion of the mixture flow will impinge upon this spoke, ensuring a significant amount of turbulence as described below.

In order to prevent fuel starvation of the engine with which the reactor plate is being used, it is necessary that the area of the flow path through which the mixture travels remains constant. In order to accomplish this, the nominal diameters of the openings 21 must be increased sufficiently so that part of each opening not obstructed by the ribs 25 or hub 27 remains equal in area to the actual diameter of its associated carburetor bore.

It will immediately become apparent to those skilled in the art that, in order to achieve this, it is necessary that the actual diameter of each opening 21 be larger than the diameter of its associated bore. In order to provide a smooth transition flow in the system then, it may be desirable to provide the upper spacer plate 17 with a chamfer or counterbore 41 and the lower spacer with a similar chamfer 43, both of which may be seen clearly in FIG. 3. In this manner, the mixture flow path area will remain constant from the carburetor to the intake manifold, with the exception of the chamfered sections 41 and 43 which are relatively short in length.

At the center of each of the openings the hub 27 may be provided with an aperture 45 which is chamfered so as to become larger in the direction of mixture flow, as illustrated in FIG. 4.

It has been found that these combined features serve to produce exceptionally well mixed fuel and air to an extent heretofore unobtainable with any prior art devices. As the mixture enters the spacer 17 opening 19, it slows down as a result of the enlargement of the flow path at the chamfer 41 which creates a "flat" in the vacuum system. Then, certain laminates in the flow strike the upper surfaces of the ribs 25. This induces a circular motion in those portions of the flow in the direction of the arrow 42 shown in FIG. 2. Any remaining droplets in these portions of the flow and those portions of the flow clockwise from rib 25, as viewed from above, will then be broken up and will thoroughly vaporize in the flow.

That portion of the mixture moving past any given flow surface 35 will continue past the rib until it reaches the downstream surface 33. At this point, the 90° angle between the flow surface 35 and the downstream surface 33 will cause turbulence in the nature of that generated when an airfoil stalls. In other words, a portion of the mixture moving past the flow surface 35 will eddy across the bottom or downstream surface 33 of the rib, again in the same clockwise direction. As the turbulent flow passing across the downstream surface 33 of each rib intercepts the turbulent flow which has been deflected by the upstream surface 31, an extremely turbulent condition arises, extending around the opening as far as the next rib, further mixing the fuel and air.

The apertures 45 in the hubs 27 may be used to compensate for discrepancies in the openings 21, i.e., to ensure that the actual area remaining in the opening is nearly identical to that of the carburetor bore. Also, these apertures may serve to partially counteract any centrifugal force of the mixture as it passes through the plate, while also ensuring that there is some mixture still existing at the center of flow. The enlargement of the aperture 45 in the downstream direction may serve to create another very small flat in the vacuum at the center of the flow to generate additional break up of the droplets as they pass therethrough. As all of the mixture passes through the reactor plate, the chamfer 43 provides a sufficient amount of space to ensure that all of the mixture has undergone the turbulence thus created. The improved mixture is then directed into the bore of the intake manifold at substantially the same velocity as it left the carburetor.

As stated previously, it has been found that the fuel economy of an engine utilizing a reactor plate employing this invention has been significantly increased, while at the same time increasing engine temperatures. These results have led to the conclusion that the fuel used in the engine has been mixed with air at the rate of approximately 90–97%. Consequently, a greater amount of fuel is completely burned providing better engine efficiency as well as a reduction in the amount of pollutants in the air, since less fuel is used and that which is used is more completely burned.

Additional embodiments of devices employing this invention will quickly become apparent to those skilled in the art; the above description has merely been employed to describe a presently preferred embodiment. The invention, as defined by the following claims, may be utilized in a variety of structures which may or may not resemble that described in actual appearance, while accomplishing the desired result.

I claim:

1. A device for improving a carbureted air-fuel mixture comprising a plate including a plurality of openings in said plate through which a carbureted air-fuel mixture may be passed, each opening spaced and segregated from all adjacent openings and having a total unobstructed area equal to that of a carburetor bore with which each opening in said plate may be aligned when said plate is employed with a carburetor, a plurality of spokes of triangular cross-sectional configuration radially fixedly located in each opening, each having a first surface against which a first portion of an air-fuel mixture passed through said opening may be deflected into a turbulent flow in a direction along a generally obtuse angle relative to the axis of said opening and a second surface across which a second portion of such an air-fuel mixture may be deflected into a turbulent flow in a direction generally perpendicular to the axis of said opening, and means for reducing the centrifugal force of such mixture portions deflected by said first and second surfaces and for ensuring mixture flow at the center of each said opening.

2. The device of claim 1 including spacer plate means, locatable on each side of said plate, each including a plurality of openings therein corresponding to those in said plate and means for altering the velocity of a mixture flow passed therethrough.

3. The device of claim 1 including means for reducing the velocity of such a mixture flow prior to the passage thereof through said opening and means for increasing the velocity of such a mixture flow after the passage thereof through said openings.

4. The device of claim 1 wherein said plurality of spokes comprises five such spokes located equidistant about each said opening, at least one of which in each opening is specifically located so as to be below a carburetor jet when said plate is located so that said openings are aligned with the bores of a carburetor with which said plate may be employed.

5. The device of claim 1 wherein said first surface is located at an obtuse angle between 95° and 135° relative to the general direction of mixture flow.

6. The device of claim 1 wherein said first surface is located at an obtuse angle of about 113° relative to the general direction of mixture flow.

7. A device for increasing the percentage of fuel which is completely mixed with air after the fuel and air leave a carburetor comprising a plate having a number of individual openings corresponding to the number of bores of a carburetor with which the device may be employed, each opening having a plurality of equi-spaced, radially located spokes therein, one of which is located so as to be directly beneath a jet in a carburetor with which the plate may be employed when said openings are aligned with the bores of such a carburetor, each spoke having a triangular cross-sectional configuration including an upstream surface located at an obtuse angle of about 113° relative to the axis of its said opening, a downstream surface located approximately perpendicular to the axis of its said opening, and a flow surface extending between said upstream and downstream surfaces substantially parallel to the axis of its said opening, each spoke in any given opening oriented so as to produce mixture rotation in the same direction as all other spokes therein, and hub means at which all of said spokes intersect near the center of each opening.

8. The device of claim 7 wherein said hub means includes a central aperture therein of such a relatively small diameter that only a very small portion of a fuel-air mixture flow passed through said opening could pass through said central aperture.

9. The device of claim 8 wherein each said opening has an actual diameter which is larger than that of the alignable bore in a carburetor with which the device may be employed, while the combined unobstructed area of each said opening between the spokes and in the central aperture is substantially equal to that of the alignable bore in such a carburetor.

10. The device of claim 9 including means for altering the velocity of the mixture before and after it passes through each said opening.

11. Apparatus for improving the mixture of a carbureted fuel-air mixture comprising a substantially planar plate means having at least one opening extending therethrough a plurality of reactor spokes integral with said plate means and in the plane thereof, joined together near the center of said at least one opening, each having a substantially triangular cross section throughout most of the length thereof, and each comprising an upstream surface formed at an obtuse angle relative to the plane of said plate means, a downstream surface formed substantially parallel to the plane of said plate means and intersecting said upstream surface, and a flow surface intersecting said upstream and downstream surfaces and extending substantially perpendicular to the plane of said plate means, and means for locating said plate means relative to a carburetor such that said at least one opening is substantially aligned with a flow mixture bore of such a carburetor bore so that all air-fuel mixture leaving such a carburetor must subsequently pass through said at least one opening.

12. The apparatus of claim 11 wherein said plurality of reactor spokes are spaced equidistant about said at least one opening.

13. The apparatus of claim 11 wherein one of said reactor spokes is so positioned in said at least one opening as to be located immediately below a jet in a carburetor relative to which said plate may be located by said locating means when said plate is employed with a carburetor.

14. The apparatus of claim 11 including hub means joining said reactor spokes together near the center of said at least one opening and including aperture means therein extending perpendicular to the plane of said plate means and uniformly enlarged from one end thereof.

15. The apparatus of claim 14 wherein said hub aperture means is so arranged as to have its largest radial dimension in the plane of said downstream surfaces of said plurality of reactor spokes.

16. The apparatus of claim 14 wherein the total cross-sectional open area of said at least one opening, measured between said reactor spokes at said downstream surfaces thereof and including said hub aperture, is substantially equal to the cross-sectional area of a carburetor bore relative to which said plate means may be aligned by said locating means when said plate means is employed with a carburetor.

17. The apparatus of claim 11 wherein said plate means includes a plurality of such openings, each of which may be aligned with the bore of a carburetor relative to which said plate means may be aligned by said locating means when said plate means is employed with a carburetor.

18. Apparatus for generating turbulence in a fuel-air mixture flow comprising plate means having a first surface, a second surface at least one opening extending through said plate means from said first to said second surface through which a carbureted mixture of fuel and air may pass, a plurality of spoke-like elements fixedly and radially located in said at least one opening, each comprising a flow surface extending between and substantially perpendicular to at least one of said first and second surfaces, a downstream surface intersecting said flow surface and extending substantially parallel to and coplanar with said second surface, and an upstream surface intersecting said flow surface and said downstream surface and extending between said first and second surfaces.

19. The apparatus of claim 18 wherein there are a plurality of said openings in said plate means, each having a plurality of said spoke-like elements therein, said spoke-like elements in each said opening being oriented so that said upstream surfaces are located on the same side of their respective flow surfaces and on the opposite side of the respective flow surfaces to those of said spoke-like elements in adjacent said openings.

20. An apparatus for creating turbulence in a flowing fuel-air mixture in order to improve the quality of the mixture comprising central support means positionable in the flow path of the fuel-air mixture, a plurality of equi-spaced turbulence generating means fixedly supported by and extending radially outwardly from said central support means, each including first means for inducing circular motion in a portion of a mixture passed through said apparatus and second means for inducing eddy currents in a portion of a mixture passed through said apparatus, said second means being so oriented as to cause such eddy currents to travel substantially perpendicular to the flow path of a fuel-air mixture passed through said apparatus and to intersect portions of such a mixture induced into circular motion by said first means, and means for fixedly supporting said central support means and said turbulence-generating means relative to the output of a carburetor bore such that the entire fuel and air mixture from such a bore must move past said first and second means.

21. The apparatus of claim 20 including means in said central support means for creating a flat in the vacuum at the center of the flow path in which said central support means is located.

22. The apparatus of claim 20 including means for reducing the velocity of such a mixture prior to its contact with said central support means and said turbulence generating means and means for increasing the velocity of such a mixture after it passes said central support means and said turbulence generating means.

23. The apparatus of claim 20 wherein each of said turbulence generating means are similarly oriented so as to generate such turbulence in the same general direction.

24. The apparatus of claim 23 including additional central support means and turbulence generating means so positioned in additional flow paths of fuel-air mixtures, wherein such additional turbulence generating means are so oriented that turbulence is generated in generally opposite directions in adjacent flow paths.

25. Apparatus for improving the mixture of fuel and air in a gaseous mixture comprising a substantially flat plate means having an upper surface, a lower surface, at least one opening extending from said upper surface to said lower surface through which a gaseous mixture of fuel and air may pass, and means located in said at least one opening for generating turbulence in a gaseous mixture passed therethrough including a flow surface extending perpendicular to and between said upper and lower surface, a downstream surface intersecting said flow surface at said lower surface and extending substantially parallel to the latter, and an upstream surface intersecting said flow surface at said upper surface and said flow surface at said lower surface.

* * * * *